US006055680A

United States Patent [19]

Tolbert

[11] Patent Number: 6,055,680

[45] Date of Patent: May 2, 2000

[54] COLLAPSIBLE TOILET PLUNGER

[76] Inventor: Gerard C. Tolbert, 3727 Cameron Hills Pl., Ellenwood, Ga. 30049

[21] Appl. No.: 09/176,640

[22] Filed: Oct. 21, 1998

[51] Int. Cl.[7] ..... E03D 11/00

[52] U.S. Cl. ..... 4/255.11

[58] Field of Search ..... 4/255.11, 255.12, 4/255.09

[56] References Cited

U.S. PATENT DOCUMENTS

| | | | |
|---|---|---|---|
| 674,179 | 5/1901 | Cooper . | |
| 2,984,852 | 2/1961 | George | 15/144 |
| 3,130,421 | 4/1964 | Quinlan . | |
| 3,172,415 | 3/1965 | Maushund . | |
| 3,644,943 | 2/1972 | Parodi fu Leonardo et al. . | |
| 4,745,641 | 5/1988 | Tash . | |
| 4,793,646 | 12/1988 | Michaud | 294/19.1 |
| 5,114,006 | 5/1992 | Wilk | 4/255.11 X |
| 5,305,882 | 4/1994 | Kaplan et al. | 4/255.09 X |
| 5,456,356 | 10/1995 | Kurzawa . | |

FOREIGN PATENT DOCUMENTS

| | | | |
|---|---|---|---|
| 0137871 | 10/1952 | Sweden | 4/255.11 |

*Primary Examiner*—Charles E. Phillips
*Attorney, Agent, or Firm*—Kenneth L Tolar

[57] ABSTRACT

A collapsible plunger includes an elongated tubular handle having a plunger member at an end thereof. The tubular handle is comprised of a plurality of telescoping sections each of which may be locked in an extended or retracted position relative to the adjacent section. The handle may be removably secured to the interior of an accompanying bag allowing the collapsed plunger to be easily and concealably transported from one location to another.

6 Claims, 1 Drawing Sheet

COLLAPSIBLE TOILET PLUNGER

BACKGROUND OF THE INVENTION

The present invention relates to a plunger having a telescoping handle allowing the plunger to be easily transported or compactly stored when not in use.

DESCRIPTION OF THE PRIOR ART

Conventional toilet plungers typically include an elongated wooden handle that is difficult to conceal and store. Accordingly, in public buildings, such as hotels and offices, a maintenance worker must manually transport the plunger from one location to another which is unsanitary and potentially embarrassing. Furthermore, even in household applications, conventional plungers will not always easily fit within a bathroom cabinet or closet. The present invention provides a plunger having a telescoping handle allowing the plunger to be conveniently and compactly stored within an accompanying carrying case or in a similar confined location.

Various plumbing devices and plungers exist in the prior art. For example, U.S. Pat. No. 674,197 issued to Cooper relates to a plunger type device including an elongated handle having a crutch member at the top end with a rubber disc at the opposing end.

U.S. Pat. No. 3,172,415 issued to Maushund relates to a cleaning apparatus for cleaning swimming pools and similar devices comprising a flexible cup pivotally secured to a pole. The pole is releasably secured to the cup so that the cup, with a cleaning solution received therein, may be placed over an algae stain. Suction will retain the cup over the algae stain until the stain is removed.

U.S. Pat. No. 3,130,421 issued to Quinlan relates to a plunger having an inclined handle allowing a user to apply additional force to the plunger.

U.S. Pat. No. 3,644,943 issued to Parodi fu Leonardo et al relates to a device for clearing blockages in plumbing comprising an elastomeric cup having a reciprocal handle attached thereto. A cup member includes an annular pressing member engaging the rim thereof for pressing the rim against the bottom of a sink or similar orifice.

U.S. Pat. No. 4,745,641 issued to Tash relates to a toilet bowl plunger comprising an elongated, knurrled handle having a pleated suction member at an end thereof.

U.S. Pat. No. 5,456,356 issued to Kurzawa relates to a combination toilet plunger cover and toilet tissue roll holder.

As indicated above, none of the prior art devices relate to a plunger having a collapsible handle according to the present invention allowing the plunger to be compactly stored or conveniently transported in an accompanying carrying case.

SUMMARY OF THE INVENTION

The present invention relates to a collapsible plunger assembly. The device comprises an elongated tubular handle formed from a plurality of telescoping sections. At an end of the handle is a plunger member of the type generally known in the prior art. Coaxially received within the handle is an elongated spring for biasing the handle towards an extended position. Each telescoping section of the handle may be locked in an extended or retracted position relative to the adjacent section with a locking means. The device also includes an accompanying carrying case in which the plunger may be transported or stored. It is therefore an object of the present invention to provide a plunger having a collapsible handle allowing the plunger to be stored in compact locations.

It is yet another object of the present invention to provide a plunger which may be stored or transported within an accompanying carrying case.

It is yet another object of the present invention to provide a plunger which may be selectively locked in an extended or retracted position. Other objects, features and advantages of the present invention will become readily apparent from the following detailed description of the preferred embodiment when considered with the attached drawings and the appended claims.

DESCRIPTION OF THE PREFERRED EMBODIMENT

Figure 1:
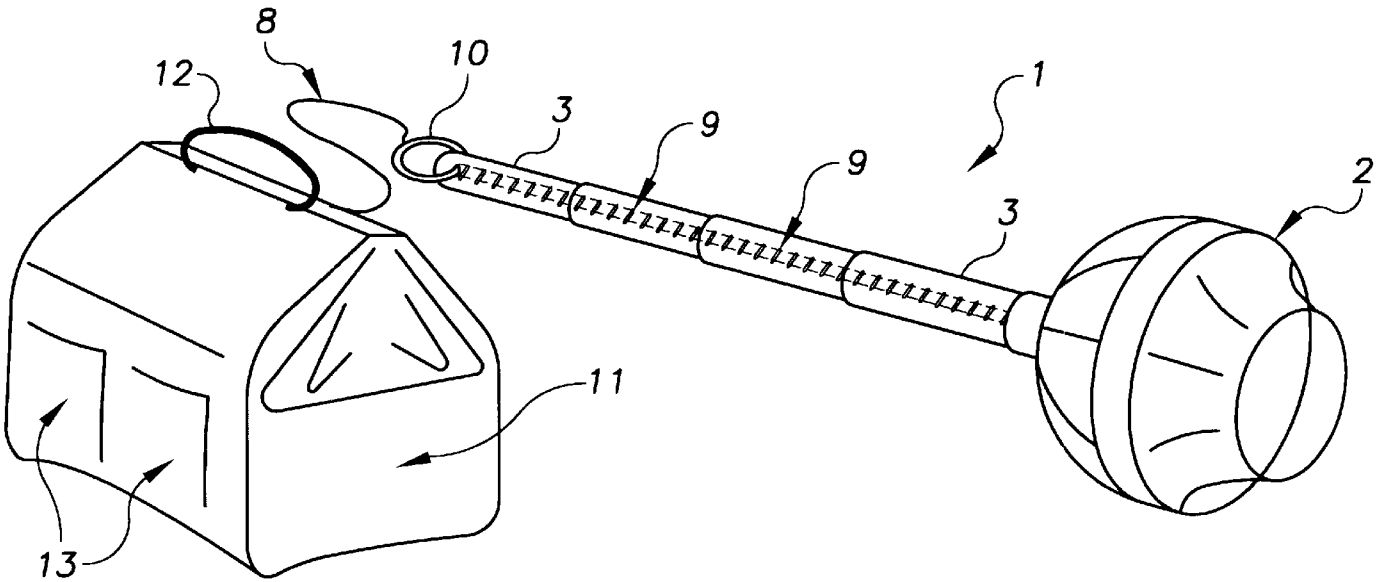
FIG. 1 is a perspective view of the inventive device secured to an accompanying carrying case.
Figure 2:
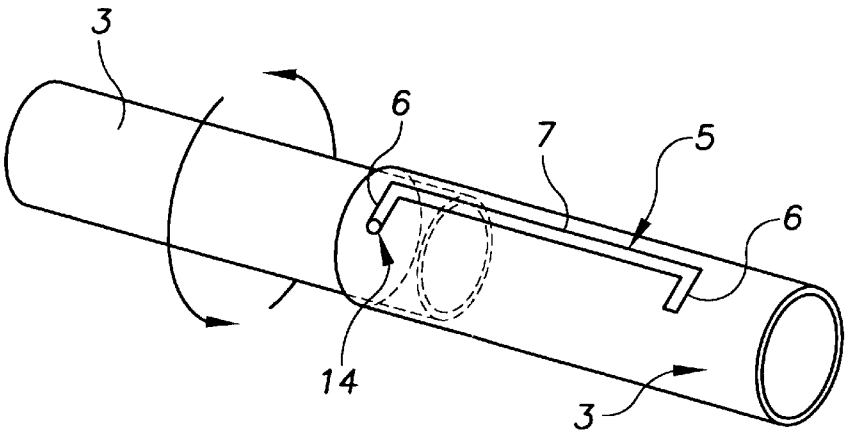
FIG. 2 is a closeup, perspective view of a pair of telescoping sections with the internal locking means depicted in phantom.

Referring now to FIGS. 1 and 2, the present invention relates to a collapsible plunger assembly. The device comprises an elongated tubular handle 1 having first and second ends with a plunger member 2 at a first end thereof. The plunger member is conventional and is made from a flexible, collapsible material such as rubber. The plunger member may have any one of a number of designs, shapes or sizes similar to those found in the prior art or described in one or more of the above referenced patents.

The tubular handle is formed of a plurality of telescoping sections 3 allowing the handle to be extended for use or retracted for storage. Each telescoping section may be selectively locked in either an extended or retracted position relative to the adjacent telescoping section using a locking means. The locking means includes a protrusion 14 on the exterior surface of each section adjacent an end thereof. Adjacent the opposing end of each section, on its interior surface, is a substantially C-shaped groove 5 for slidably receiving the protrusion on an adjacent section telescopingly received therein. Each groove includes a pair of parallel lateral portions 6 within which the protrusion slides when a section is rotated relative to an adjacent section and a longitudinal portion 7 therebetween within which the protrusion slides when a section is being extended or retracted relative to the adjacent section. An elongated spring 9 is coaxially received within the tubular handle for biasing the handle sections toward an extended position. Accordingly, a first section may be rotated relative to the second section and extended or retracted relative thereto. The section may then be rotated in the opposite direction to selectively lock the two adjacent telescoping sections in their respective positions. Therefore, the length of the handle may be selectively varied anywhere between a fully extended and fully retracted position.

At the end of the handle opposite the plunger member is a ring 10, hook or similar means to which a cord 8, string, rope or similar means may be removably attached. The cord is detachably secured to an interior chamber of an accompanying carrying case 11 in which the plunger assembly may be transported when in a collapsed position. The carrying case also includes a handle member 12 and preferably one or more accessory pockets 13 on its exterior surface.

The plunger member may be manufactured with any suitable materials such as rubber, while the handle sections may be constructed with plastic or metal. The handle sections are preferably coated with rubber for enhanced comfort. However, as will be readily apparent to those skilled in the art, the size, shape and materials of construction may be varied without departing from the spirit of the present invention.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A collapsible plunger assembly comprising:

an elongated, telescoping tubular handle having first and second ends, said handle formed of a plurality of hollow telescoping sections, each section having an interior and an exterior surface;

a plunger member secured to the first end of said handle whereby said handle can be selectively extended and collapsed allowing said plunger assembly to be stored in a compact location;

a locking means for selectively fixing said handle at a desired length;

a hook means on the second end of said handle for removably securing said handle to a storage device;

a carrying case having an interior chamber dimensioned to retain said plunger assembly when said handle is in a collapsed position;

a cord means having two ends with the first end attached to said hook means and the second end removably secured within the carrying case interior chamber.

2. A device according to claim 1 wherein said locking means comprises:

a protrusion on the exterior surface of each telescoping handle section, said protrusion adjacent a first end of said handle section;

a groove on the interior surface of each telescoping section, said groove adjacent a second end thereof for slidably receiving the protrusion whereby a first section is rotated in one direction relative to an adjacent section to extend and retract said first section and is rotated in an opposite direction to lock said first section relative to the adjacent section.

3. A device according to claim 2 wherein said groove includes a pair of lateral portions within which said protrusion slides when a first section is rotated relative to the adjacent section and a longitudinal portion therebetween within which said protrusion slides when the first section is extended and retracted relative to the adjacent section.

4. A device according to claim 1 wherein said carrying case includes an exterior surface with at least one accessory pocket thereon.

5. A device according to claim 1 wherein said handle is spring biased towards an extended position.

6. A device according to claim 1 wherein said handle sections are coated with rubber to enhance comfort when grasped by a user.

* * * * *